US011739558B1

(12) United States Patent
Acacio

(10) Patent No.: US 11,739,558 B1
(45) Date of Patent: Aug. 29, 2023

(54) EFFICIENT APPARATUS FOR INSTALLATION OF WIRE FENCING AND METHOD OF INSTALLATION

(71) Applicant: Joshua Clayton Acacio, Williamsburg, WV (US)

(72) Inventor: Joshua Clayton Acacio, Williamsburg, WV (US)

( * ) Notice: Subject to any disclaimer, the term of this patent is extended or adjusted under 35 U.S.C. 154(b) by 0 days.

(21) Appl. No.: 18/050,582

(22) Filed: Oct. 28, 2022

(51) Int. Cl.

| | |
|---|---|
| ***E04H 17/26*** | (2006.01) |
| ***B65H 57/14*** | (2006.01) |
| ***B65H 57/16*** | (2006.01) |
| ***E04H 17/02*** | (2006.01) |
| ***B65H 49/20*** | (2006.01) |
| *B65H 57/12* | (2006.01) |
| *E04H 17/06* | (2006.01) |

(52) U.S. Cl.
CPC ..... *E04H 17/266* (2013.01); *B65H 49/20* (2013.01); *B65H 57/14* (2013.01); *B65H 57/16* (2013.01); *E04H 17/02* (2013.01); *B65H 57/12* (2013.01); *B65H 2701/364* (2013.01); *E04H 17/06* (2013.01); *E04H 17/127* (2021.01); *Y10T 29/49616* (2015.01); *Y10T 29/49826* (2015.01)

(58) Field of Classification Search
CPC ..... E04H 17/06; E04H 17/266; E04H 17/127; E04H 17/02; B65H 2701/364; B65H 57/14; B65H 57/16; B65H 57/26; B65H 57/12; Y10T 29/49826; Y10T 29/49616
See application file for complete search history.

(56) References Cited

U.S. PATENT DOCUMENTS

| | | | | |
|---|---|---|---|---|
| 2,914,270 A * | 11/1959 | Parker | B65H 49/32 | 242/399.1 |
| 3,934,655 A * | 1/1976 | Whistle | E04H 17/261 | 173/28 |
| 4,208,021 A * | 6/1980 | Wall | B65H 49/32 | 242/129 |
| 5,163,634 A * | 11/1992 | Moon | E04H 17/266 | 242/598.5 |
| 5,582,216 A * | 12/1996 | Smith | B21F 33/00 | 140/16 |
| 5,632,470 A * | 5/1997 | Leland | E04H 17/266 | 254/323 |

(Continued)

*Primary Examiner* — Jermie E Cozart
(74) *Attorney, Agent, or Firm* — Dinsmore & Shohl LLP; Monika Jaensson

(57) ABSTRACT

A portable apparatus for use in the installation of wire fencing, including a frame mountable to a skid steer or tractor loader, a pair of spinning jenny support posts supporting a plurality of spinner support bars, each support bar provided to receive and support a spinning jenny dereeler. At a distal end of the frame is provided a hinged wire guide including at opposing ends an inner pair of grooved rollers and an outer pair of grooved rollers. Compartmentalized tool chests may be secured to portions of the frame as well as gate racks, to transport gates, equipment and supplies to the installation site. Guide sticks are provided, each presented with differing numbers of apertures positioned at pre-determined heights along the stick, for use in efficiently installing fencing along the fence line. A method for installing fencing along a fence line is also provided, using a portable apparatus supporting a plurality of spinning jenny dereelers, a hinged wire guide, and a guide stick.

16 Claims, 13 Drawing Sheets

(56) References Cited

U.S. PATENT DOCUMENTS

| | | | | |
|---|---|---|---|---|
| 10,533,341 | B1 * | 1/2020 | Hicks | B65H 57/06 |
| 2011/0121125 | A1 * | 5/2011 | Stow | B66F 9/184 254/214 |
| 2020/0048026 | A1 * | 2/2020 | Hicks | B65H 57/06 |
| 2021/0140195 | A1 * | 5/2021 | Taylor | E04H 17/266 |

* cited by examiner

EFFICIENT APPARATUS FOR INSTALLATION OF WIRE FENCING AND METHOD OF INSTALLATION

FIELD OF INVENTION

The disclosed technology is an apparatus for use in the installation of wire fencing, mountable on a skid steer or tractor to move the apparatus for purposes of efficiently installing wire fencing. The disclosed technology further provides a method for efficiently installing wire fencing by means of an apparatus as herein disclosed generally and through exemplary embodiments, mounted on a skid steer/tractor.

BACKGROUND

Installation of fencing, including electrical fencing, can be cumbersome and time consuming, including multiple people and vehicles to provide equipment and fencing to and along the fence line. Further, each fence, depending on its purpose and the land undulation at the place of installation, requires differing numbers of strands and strand placement on posts. For example, for purposes of containing cattle, horses and other large animals, three strands may be used, at a total height of 40", or for a boundary fence 46" total height; for hogs, three strands at a total of 24" may be suitable. Alternatively, for a feedlot, horse, or boundary fence five or ten wires totaling 52" may be appropriate. Additional fence strands are beneficial to keep predators out of the contained area, and where the land undulates. In many areas, wherein the land is significantly undulated, up to ten strands are necessary.

Therefore there is a need for a system and apparatus to efficiently provide fence strands and other related equipment and supplies to a site along a fence line. Further, there is a need for a portable apparatus which can be coupled with a skid steer or tractor, and capable of providing fence strands while driving the skid steer/tractor in either the forward or reverse directions.

GENERAL DESCRIPTION

Provided herein, through embodiments hereinafter set forth and drawings provided, is a portable apparatus for use in the installation of wire fencing, mountable on a skid steer (or tractor loader, used interchangeably in this written description) to move the apparatus for purposes of efficiently installing wire fencing, and a method for efficiently installing wire fencing.

The portable apparatus, as presented through embodiments hereinafter disclosed, includes a frame mountable to a skid steer, the frame including a bottom support structure, an upper rack support structure, and a plurality of frame support posts securing the bottom support structure to the upper rack support structure. At a proximal end of the frame is a skid steer mounting plate to mount the apparatus to a skid steer.

A pair of spinning jenny support posts are affixed to the frame, each being adjacent to one of the frame support posts. These spinning jenny support posts may be provided as multiple, independently rotatable segments, or as a solid, stationary post. Affixed to each spinner support post are one or more spinner support bars, each support bar provided to receive and support a spinning jenny dereeler. When the spinning jenny support posts are presented as multiple, independently rotatable segments, each spinner support posts is affixed to one of the segments; when the spinning jenny support post is presented as a solid, stationary post, the spinner support posts are rotatably mounted to the spinning jenny support post. In either configuration, rotation of the support post segments or the rotationally mounted spinner support posts may be selectively halted into an operational position by means of a spring loaded bolt latch. This latch includes a bracket mounted on a frame support post adjacent to the spinning jenny support post, as well as a bolt and a spring. By this configuration, the latch bolt is positioned to be received in and removable from an aperture of the corresponding spinner support bar when the spinner support bar is in an operational position.

At a distal end of the frame is provided a hinged wire guide, which includes upper and lower bars, each presented in segments, with one or more hinges for hingedly securing the segments of the upper bar and the lower bar, respectively. The hinged wire guide further includes an inner pair of grooved rollers at one end of the hinged wire guide (which may be secured to the proximal end of the frame), and an outer pair of grooved rollers at an opposing end of the hinged wire guide, thereby allowing the hinged wire guide to assume a compact position to facilitate storage and transport of the apparatus, while allowing the hinged wire guide to assume multiple extended positions when the apparatus is in use. The position of the hinged wire guide relative to the frame may be controlled by a powered telescoping system, coupled with the compressor of the skid steer, and thereby operational from the skid steer.

The portable apparatus may further include and by means of its bottom support structure support one or more tool chests, compartmentalized to provide necessary tools to the fence installation site. Further, the portable apparatus may include one or more guide sticks useful in stringing a plurality of wires along a fence line, each guide stick presented with varying numbers of apertures positioned at pre-determined heights along the guide stick.

The upper rack support structure may further support and provide a pair of gate racks, on one or both sides of the upper rack support structure. These racks may include long horizontal support tubes, and at a distal end of each tube a cradle, the tubes being secured within and extendible from receptacles secured to the upper rack support structure.

The disclosed technology further provides a method for installing fencing along a fence line. In this method, a plurality of spinning jenny dereelers loaded with fence strand are installed on a portable apparatus herein provided, and the portable apparatus is secured to a skid steer. The skid steer then moves the portable apparatus to the end of the intended fence line. Once at the site, the hinged wire guide of the apparatus is extended to assume one of a plurality of positions, either manually or through the use of a powered telescoping system, and the fence strand is dispensed from at least some of the spinning jenny dereelers through the aligned grooves of the inner pair of grooved rollers and the outer pair of grooved rollers of the hinged wire guide. Next, the fence strand is inserted through the apertures of one of the guide sticks, the guide stick is aligned with a first post, and the fence strands are secured to the fence post so that the strands are spaced on the first post in accordance with the spacing between the apertures of the guide stick. The skid steer is then moved along the fence line, the guide stick is aligned with a subsequent fence post, and the fence strands are similarly secured to the post, and the process is repeated.

When gates are to be installed along the fence line, the method includes loading one or more gates on a pair of gate racks of the apparatus, and removing the same from the gate racks for installation.

When diagonal bracing is desired along the fence line, the method further comprises drawing strand from another spinning jenny dereeler supported at the top and distal end of the frame, and alternatingly securing the same to the upper or lower ends of the fence posts forming the needed diagonal bracing in the fence line.

In this method, the spinning jenny dereelers may be installed (and replaced) from the respective spinner support bars by decoupling a spring loaded latch securing the support bar or a segmented portion of the spinning jenny support posts to an adjacent frame support post, allowing the spinner support bar to move out of the operational position and is readily accessible for installing, replacing or reloading a spinning jenny dereeler loaded with fence strand.

DETAILED DESCRIPTION

Figure 1:
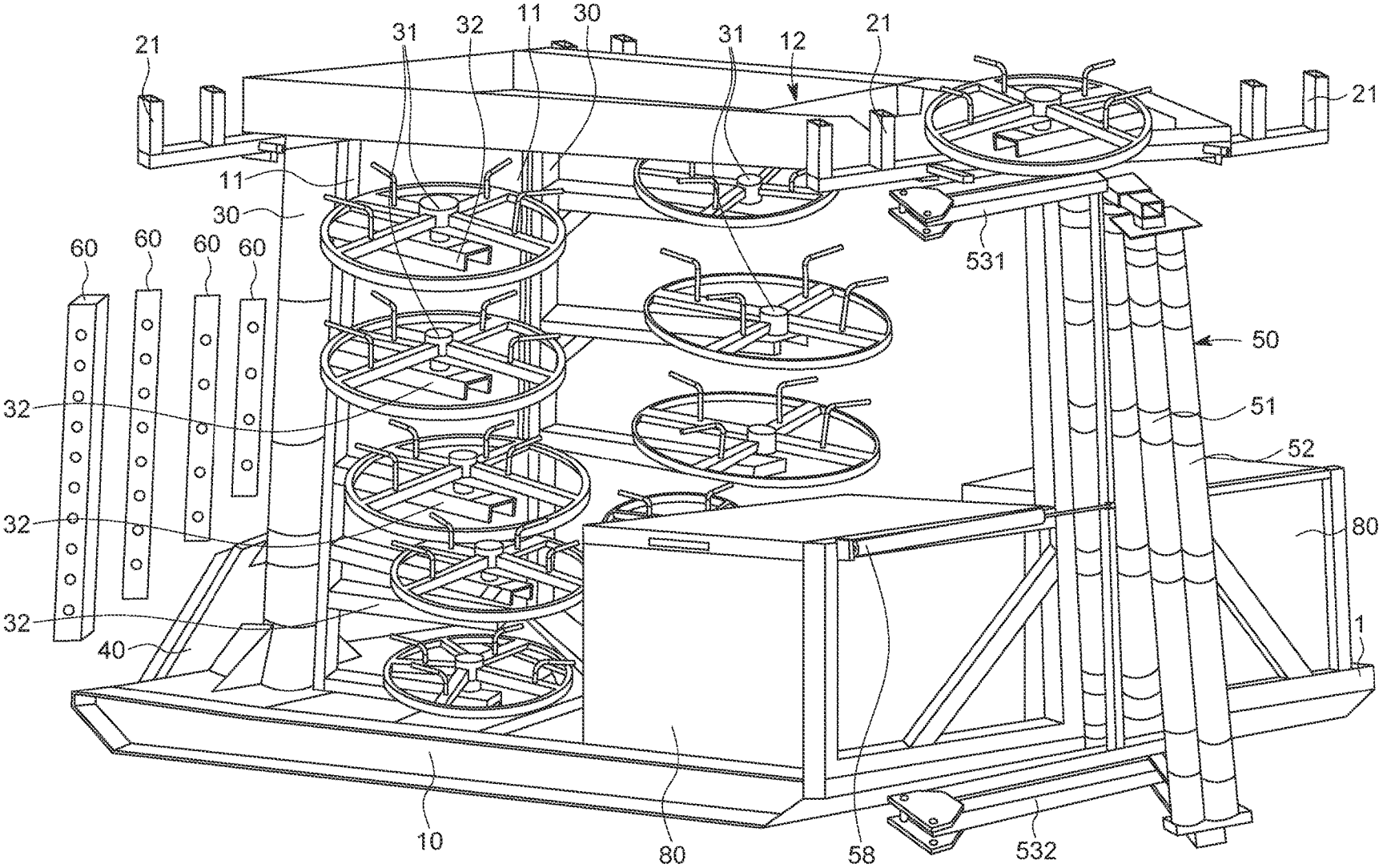
FIG. 1 is a perspective view of an embodiment of the disclosed technology, with the hinged wire guide in the compact position.

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details, or with equivalents thereof. Elements and features of some embodiments may be incorporated into other embodiments, although not specifically referenced herein.

The apparatus of the disclosed technology includes, most generally, a frame 1, a plurality of spinning jenny dereelers 31, and a hinged wire guide 50.

As shown in the embodiment of FIGS. 1, 2, 9 and 10, the frame 1 may include a bottom support structure 10, an upper rack support structure 12, and a plurality of frame support posts 11 securing the upper rack support structure to the bottom support structure. Additional frame support posts may be provided to further reinforce the frame and its components. The upper rack support structure 12 may comprise one or more vertical dividers, and lipped sides, to organize and contain for transport ancillary equipment to the fence line, such as post tops or ends, a cooler and guide sticks 60 as hereinafter described.

Figure 3:
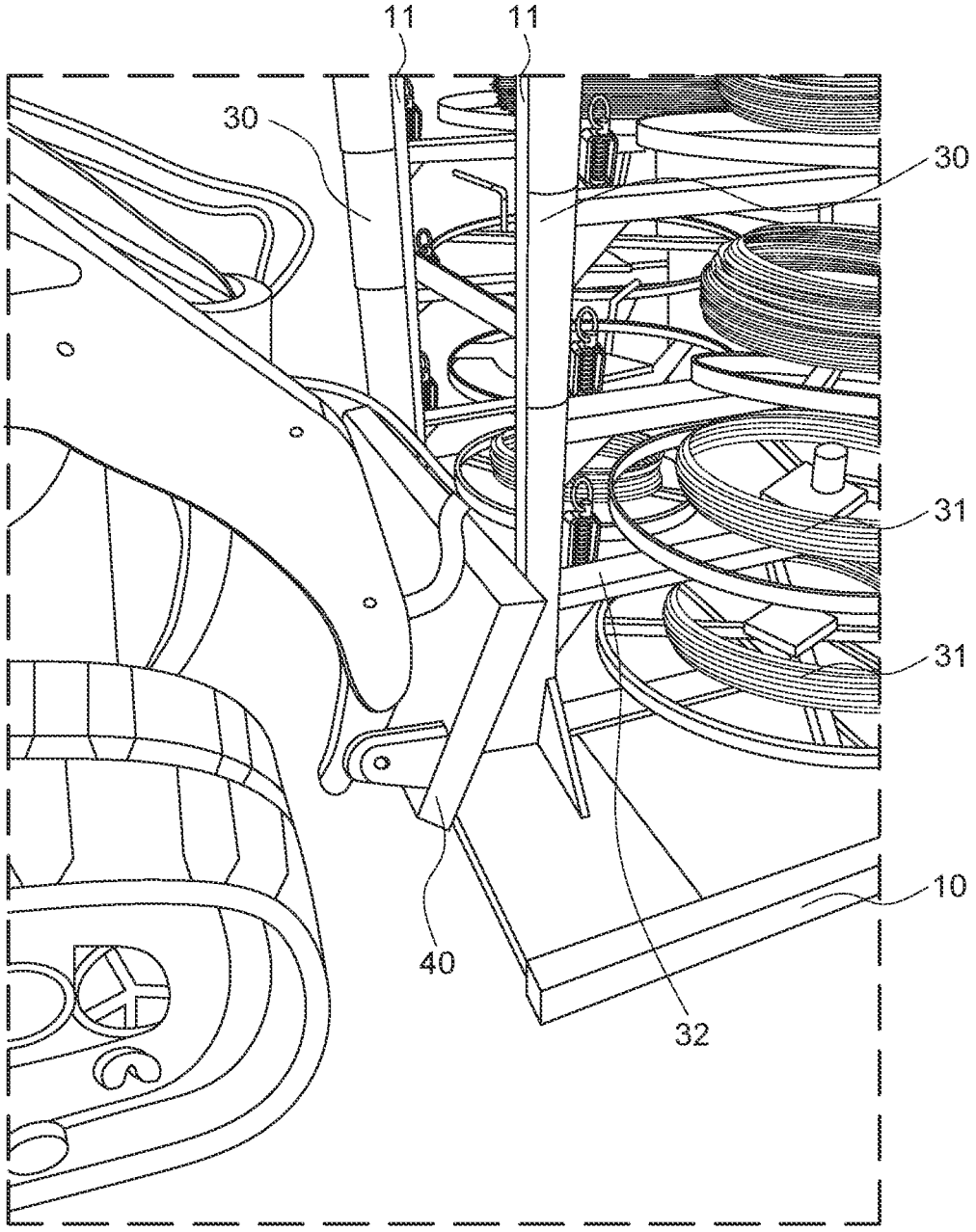
FIG. 3 is another perspective view of the embodiment of FIG. 1, showing affixation of the apparatus to a skid steer.
Figure 4:
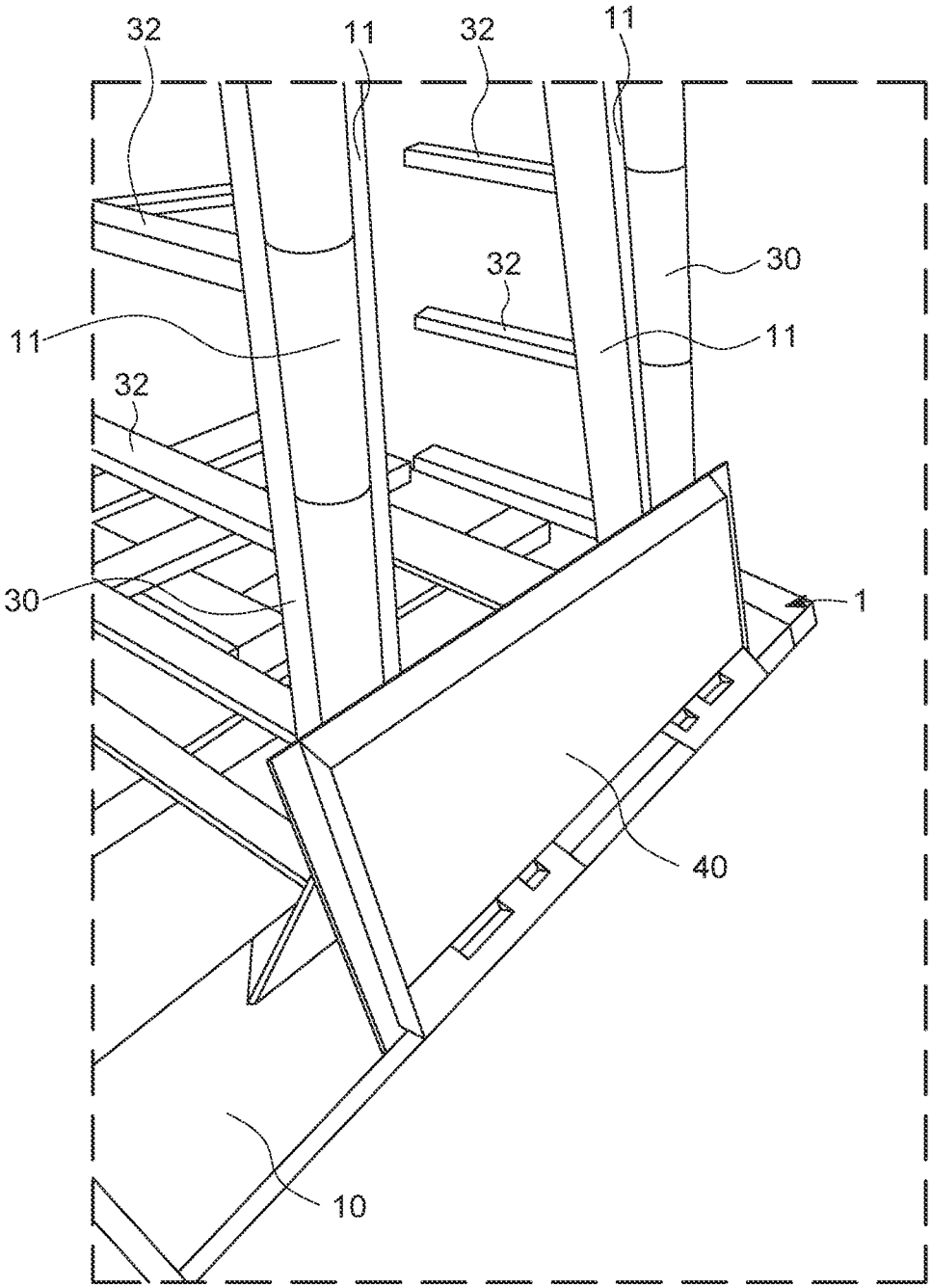
FIG. 4 shows an end view of an embodiment of the frame of the disclosed technology.

In the embodiment shown, a skid steer mounting plate 40 is affixed to a proximal end of the frame (see, in particular, FIGS. 3 and 4), and a pair of spinning jenny support posts 30 are affixed to the bottom support structure, each adjacent to a frame support post on opposing sides of the frame. To provide for the significant number of spinning jennies that the apparatus may support while maintaining a manageable overall size for maneuverability by means of the skid steer, the frame support posts and the spinning jenny support posts may each be about four to six feet long.

Figure 5:
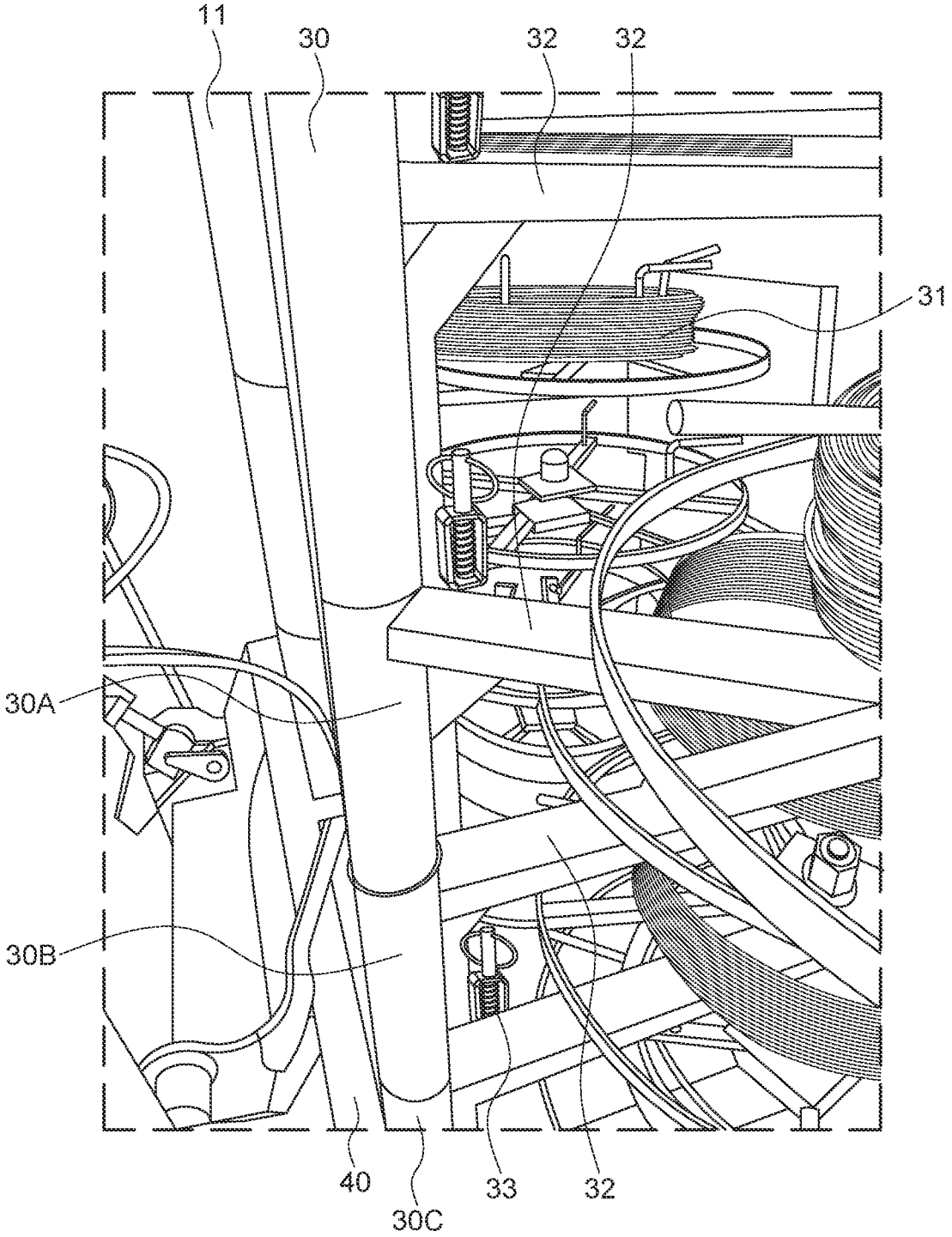
FIG. 5 shows a perspective view of the spinning jenny support posts, spinner support bars and installed spinning jenny dereelers of the disclosed technology.
Figure 6:
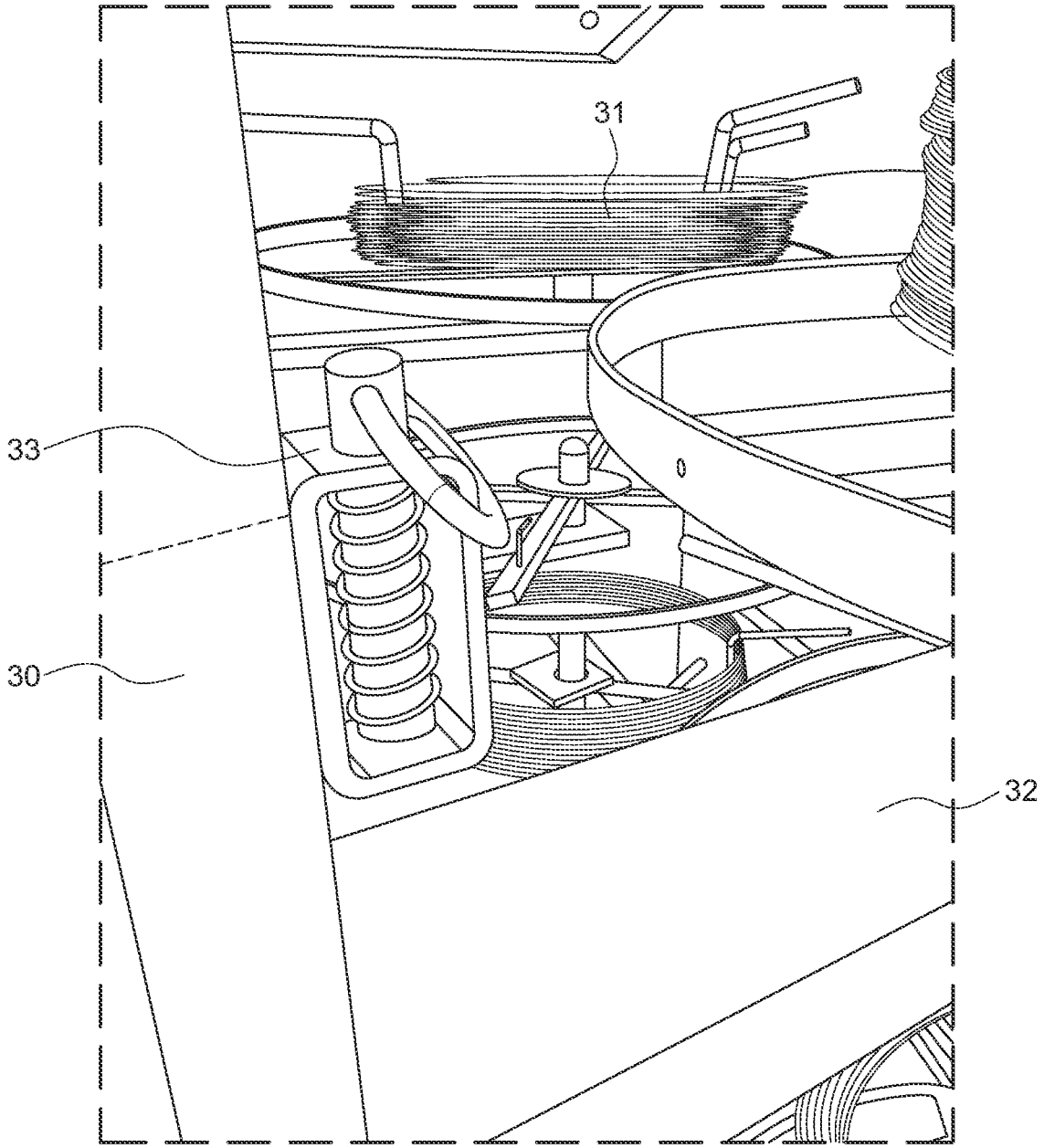
FIG. 6 shows a closer view of the spinning jenny support posts as removably affixed to a frame support post.
Figure 7:
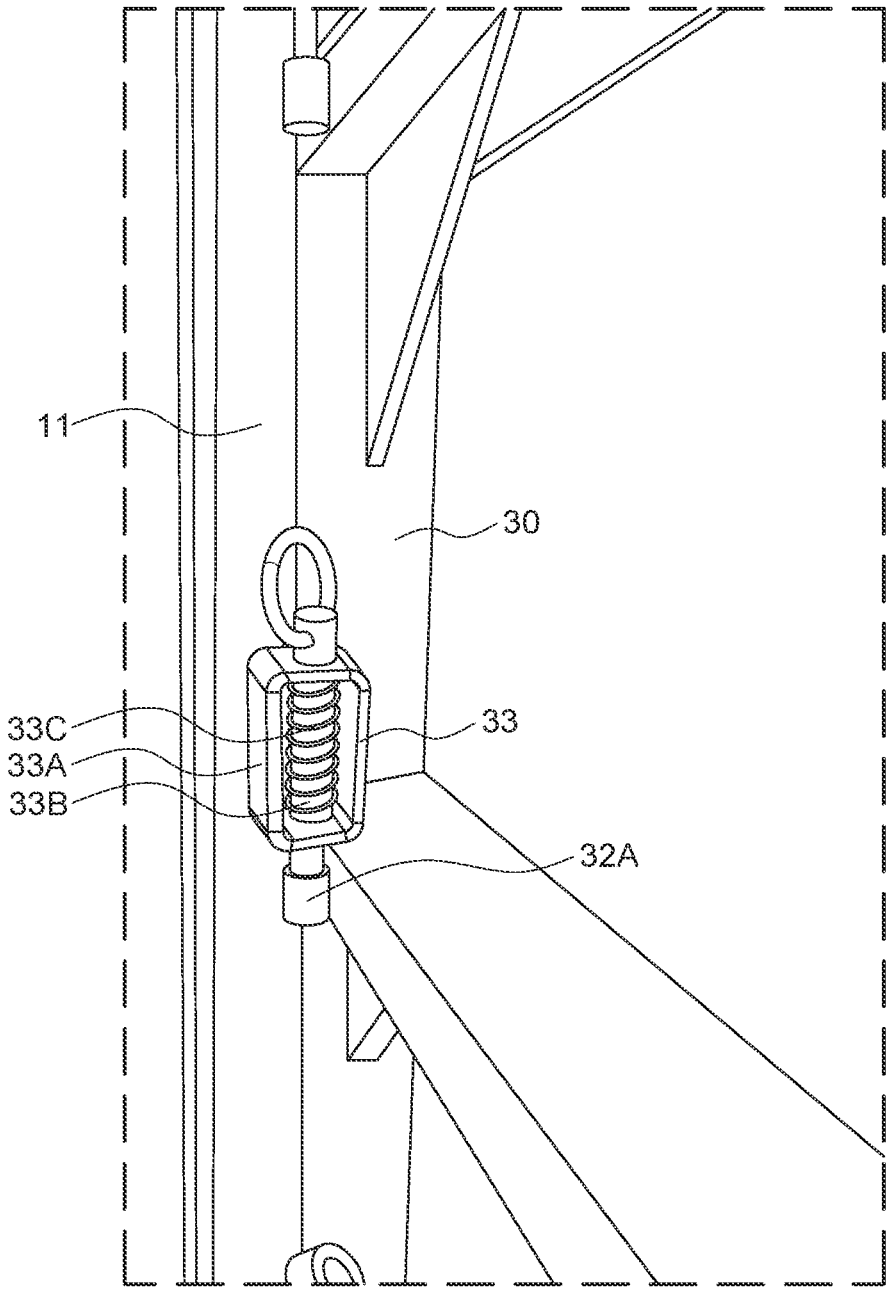
FIG. 7 shows another view of the spinning jenny support posts as removably affixed to a frame support post by means of a spring loaded bolt latch.

Rotatably secured to each spinning jenny support post 30 are a plurality of spinner support bars 32; alternatively, the spinning jenny support posts 30 may comprise multiple aligned segments 30A, 30B, 30C, etc. (see, e.g., FIG. 5), each segment being independently rotatable about a core, and supporting a single spinner support bar 32. In either of these configurations, and as shown in FIGS. 5-7, rotation of the spinner support bar or the post segment is impeded by a spring loaded bolt latch 33, comprising a bracket 33A, a bolt 33B and a spring 33C, wherein the bracket is affixed to the adjacent frame support post 11, and the bolt is aligned with (and received in) an aperture 32A of an extension affixed to a side of the spinner support bar 32 when in an operational position (shown in FIG. 7). Removing the bolt from the aperture allows the spinner support bar or the post segment to rotate out from the operational position into an easily accessible space for reloading or replacing the spinning jenny dereeler.

While secured at one end to the spinning jenny support post 30, in either of the afore-described configurations, each of the spinner support bars 32 further removably supports a spinning jenny dereeler 31 on its top surface, near an opposing end, such that the rotation of the spinning jenny dereeler is not impeded by its position or affixation to the spinner support bar. As shown in the embodiment of FIGS. 1, 2, 9 and 10, five spinner support bars are secured to each spinning jenny support post to provide ten spinning jenny dereelers.

Figure 2:
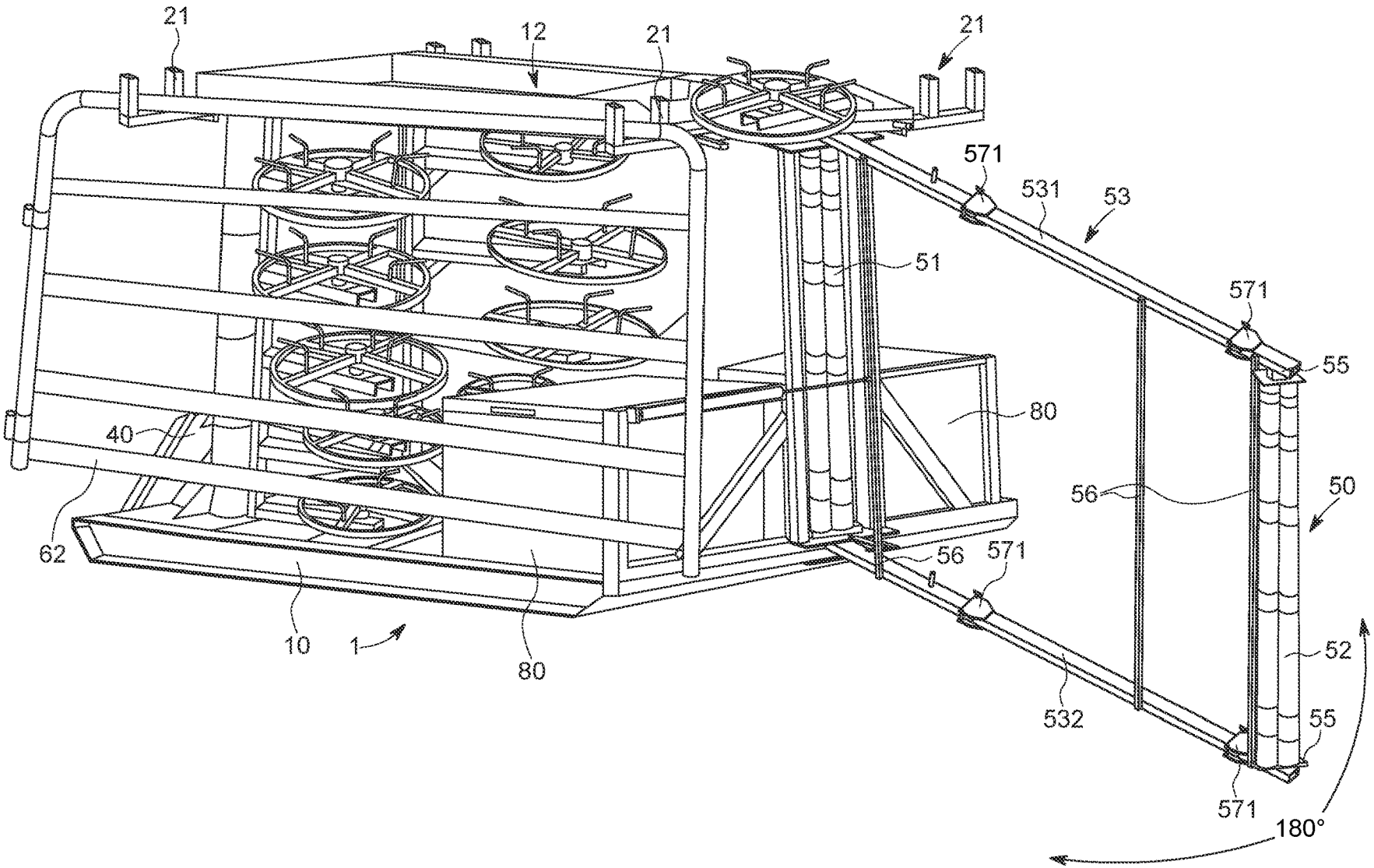
FIG. 2 is a perspective view of the embodiment of FIG. 1, with the hinged wire guide in the extended position.
Figure 9:
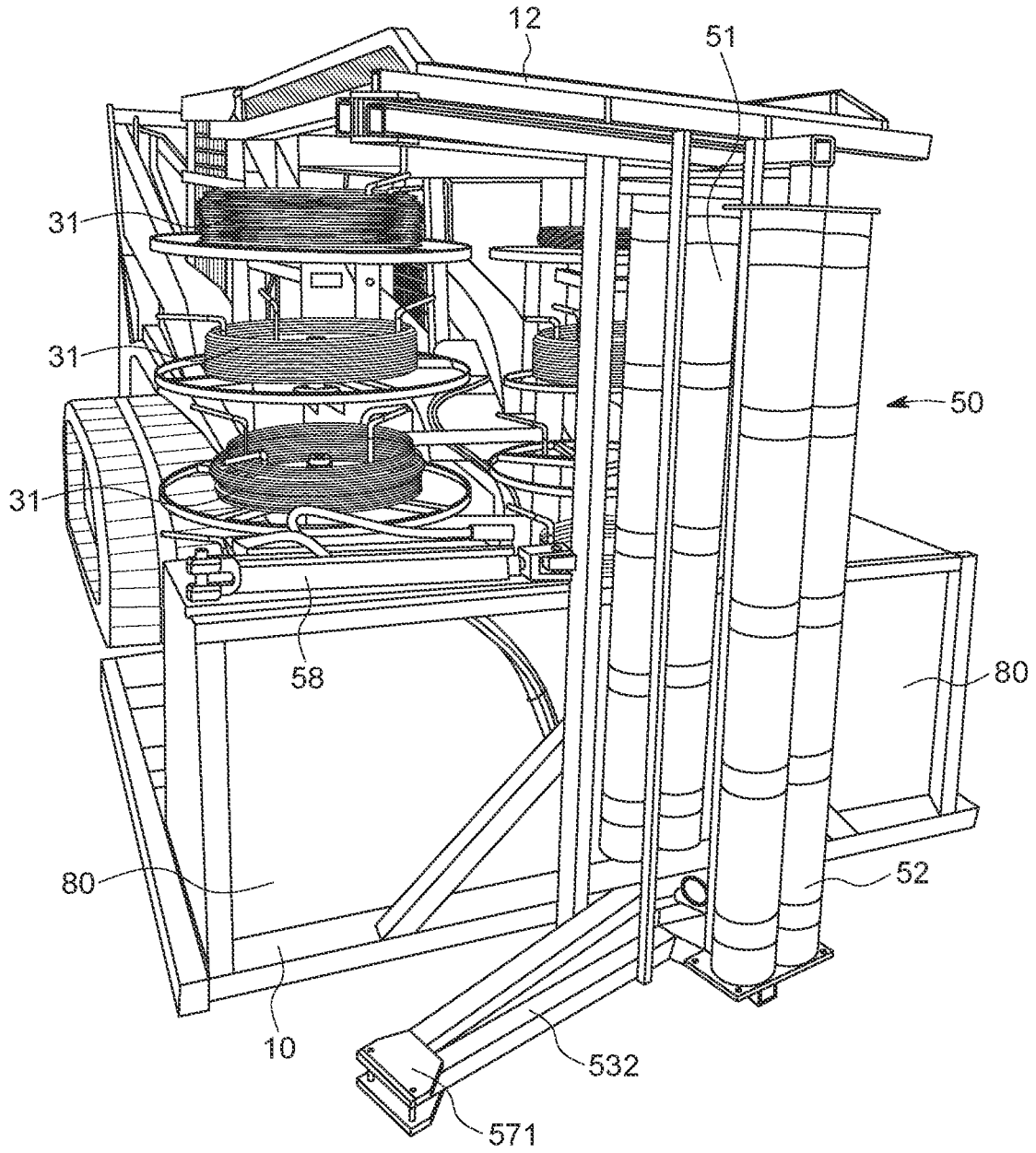
FIG. 9 shows a front view of an embodiment of the disclosed technology.
Figure 10:
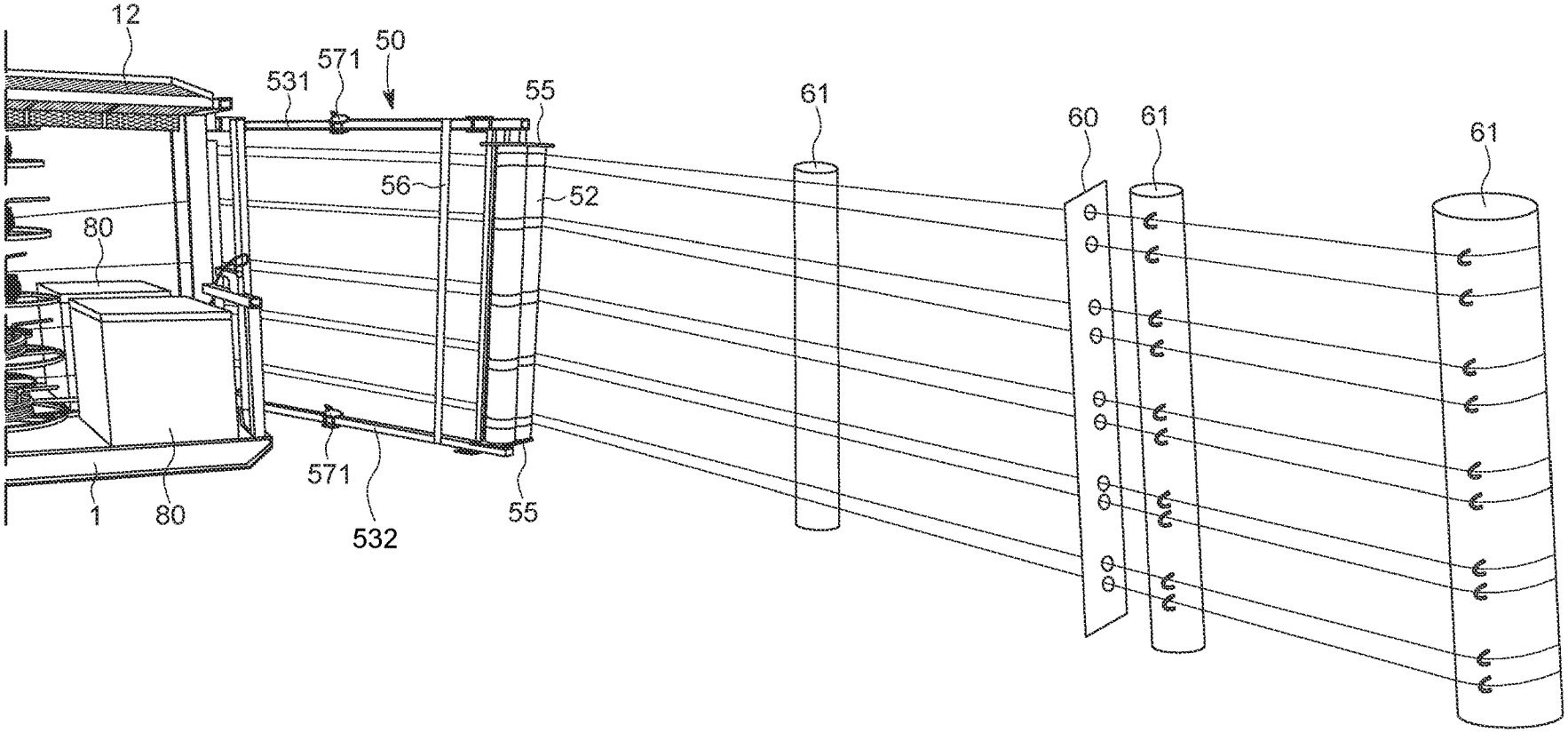
FIG. 10 shows an end view of an embodiment of the disclosed technology, with the hinged wire guide extended along a fence line.

Centrally affixed to a distal end of the frame 1 is a hinged wire guide 50, shown in FIGS. 1 and 9 in its compact position, useful when transporting the apparatus to the work site/fence line or when installing fencing by driving the skid steer in reverse. Further, the hinged wire guide is shown in FIGS. 2 and 10 in various of its extended positions, recognizing that the guide can fully extend 180 degrees about the distal end of the frame, useful in supplying fence stranding for installation of a fence when driving the skid steer in the forward or reverse directions. As shown in these figures, the hinged wire guide comprises a hinged support structure 53 supporting an inner pair of grooved rollers 51 and an outer pair of grooved rollers 52, wherein corresponding grooves of each and both pairs of rollers are aligned to receive and facilitate organized delivery of the strands from the spinning jenny dereelers to the fence line as the apparatus is moved by the skid steer.

Figure 11:
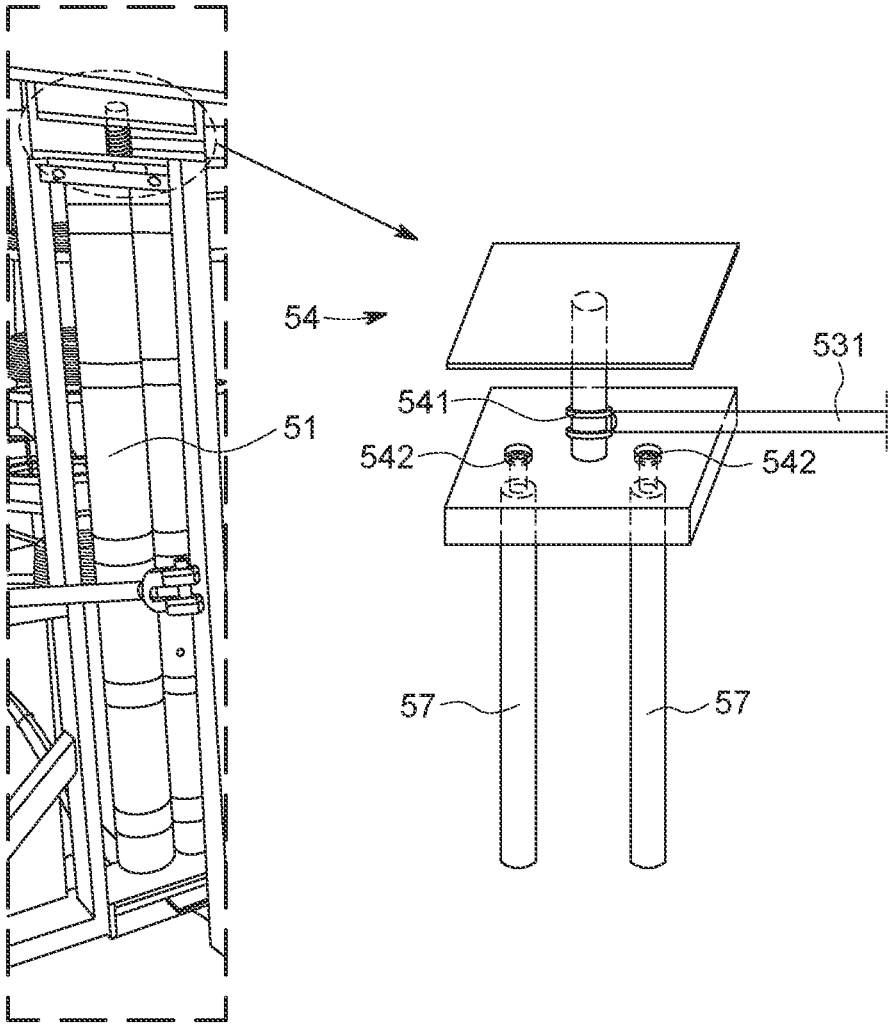
FIG. 11 shows a view of an affixation of the inner pair of grooved rollers as affixed to the frame of the disclosed technology.

The hinged support structure 53 includes an upper bar 531 and a lower bar 532. The upper bar is rotatably secured at a first end to elements of the frame, such as frame support posts or the upper rack support structure. For example, as shown in FIG. 11, the upper bar may be rotatably secured to an internal post 541 centrally positioned between two plates forming an inner support structure 54, this support structure being secured between two frame support posts 11 at the distal end of the frame. In this configuration, the post 541 is received within one or more aligned apertures extending from the first end of the upper bar 531, thereby providing bi-directional, 180 degree rotation of the upper bar relative to the frame. Further, in this configuration the bottom surface of this inner support structure also serves as a point of rotatable affixation for the upper end of each of the inner pair of grooved rollers 51, wherein each of the grooved rollers includes a central post 542, extending from each roller end, said post being received within a corresponding aperture of the bottom plate of the inner support structure, thereby securing each of the rollers to the hinged support structure or frame while allowing the rollers to rotate freely when dispensing strands to the fence line.

In like configuration, a second inner support structure 54 having a post centrally secured between two plates is affixed to and between the frame support posts 11 or the bottom support structure 10, to rotatably secure the lower bar 532 of the hinged support structure in like fashion, wherein the post is positioned and secured within aligned apertures extending from the lower bar 532. The upper surface of this inner support structure can serve as a point of rotatable affixation for the bottom of each of the inner pair of grooved rollers, wherein the central post 542 of each of the rollers is received within a corresponding aperture of this upper plate, securing the rollers to the hinged support structure or frame while allowing the rollers to rotate freely when dispensing strands to the fence line.

The outer pair of grooved rollers 52 of the hinged wire guide are rotatably supported to an opposing end of the hinged support structure 53, for example between plates 55 affixed to the distal end of each of the upper bar 531 and the lower bar 532. As with the inner pair of grooved rollers, central posts may extend from each end of the roller and be received within aligned apertures on the plates 555, thereby securing the rollers to the working end of the hinged support structure while allowing them to freely rotate when dispensing strands to the fence line.

To provide strength and stability to the hinged wire guide, one or more vertical posts 56 may be positioned between and affixed to either corresponding side of the upper and lower support bars 531, 532, along their length (when a pneumatic cylinder system is provided, as hereinafter described, the vertical posts are positioned on the side closest to the pneumatic cylinder system). Positioning these vertical posts on a side of the upper and lower support bars, rather than centrally between them, allows the fence strands to be dispensed unimpeded between the first and second pair of grooved rollers.

In order facilitate storage of the hinged wire guide during transport and for use (when driving the skid steer in reverse) as well as extended positions when driving the skid steer forward or in reverse, each of the upper bar and the lower bar are presented as two or more hinged segments. As shown in FIGS. 9 and 10, aligned pairs of hinges 571 may be provided between the upper bar segments and likewise between the lower bar segments, wherein each of the hinges allow for rotation of either or both of the bar segments. In the embodiment shown, this hinge 571 may comprises a pair of plates, wherein each bar segment is secured to a side of the hinge (by a post, through aligned apertures of the plates and the bars) such that the bars may rotate partially about the hinge and assume a compact or extended position. To secure the segments in one or more positions relative to the hinge, the plates may include apertures to receive one or more pins, which based upon the placement of the aperture secures a corresponding bar segment to a fixed position relative to the hinge, through aligned apertures of the segment, or impedes movement of the segment relative to the hinge. Other known methods to hinge and secure the bar segments in a plurality of positions may be used.

To facilitate movement of the hinged wire guide between its compact and extended positions, and to inhibit movement of the guide in the extended position, a powered telescoping system 58, such as an electric cylinder, a pneumatic cylinder system, or a hydraulic cylinder system, may be provided. As shown in FIG. 2, one end of the powered telescoping system may be rotatably affixed to the frame, and the other end rotatably affixed to one of the vertical posts 56 of the hinged wire guide. Operation of the powered telescoping cylinders may be controlled by a motor (including the skid steer motor), a motorized compressor, or a hydraulic pump, provided as an integral part of the telescoping cylinders or as a separate unit.

Figure 8:
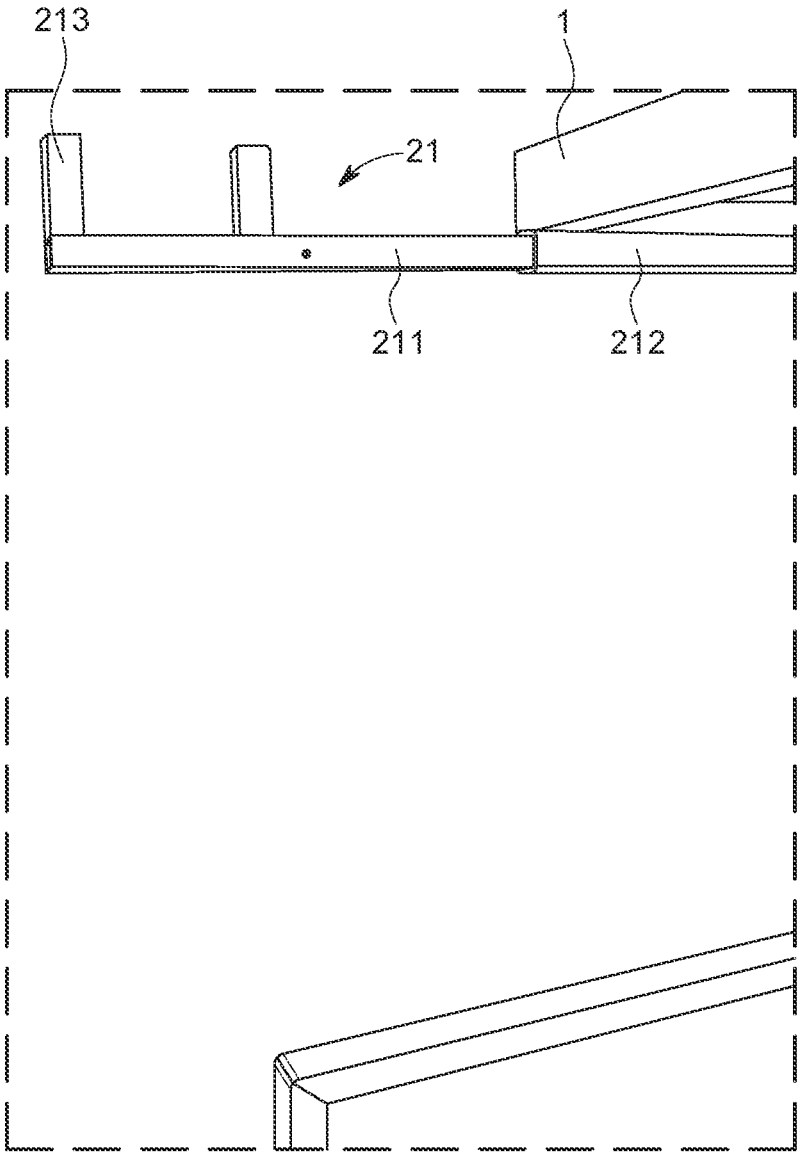
FIG. 8 shows an embodiment of a pair of gate racks extending from an upper rack support structure of the disclosed technology.

Further provided in embodiments of the disclosed technology are gate racks 21, which provide storage for gates 62 to be transported to and installed along the fence line. As shown in FIGS. 1, 2 and 8, a pair of gate racks 21 may be extendably secured within receptacles 212, the receptacles being secured to or integral with an undersurface of the upper rack support structure 12. In this configuration the gate racks include a long horizontal support tube 211 received within, supported by and extendible from the receptacles 212, each including at the distal end thereof a cradle 213. A pair of cradles, as shown in FIGS. 1, 2 and 8, may be sized to hold up to three gates. Further, as shown in FIGS. 1 and 2, a pair of gate racks 21 may be installed on each side of the frame, thereby supporting up to six gates. During transport, a strap may be used to secure a portion of the gates within the extended cradles.

It may be desirable to further install diagonal fencing braces along the fence line. Therefore, another spinning jenny dereeler 31 may be rotatably and removably secured to the top of and the distal end of the frame, as shown in FIGS. 1 and 2. Strands from this dereeler are not intended to engage with or be dispensed by the hinged wire guide as hereinabove described.

Figure 12:
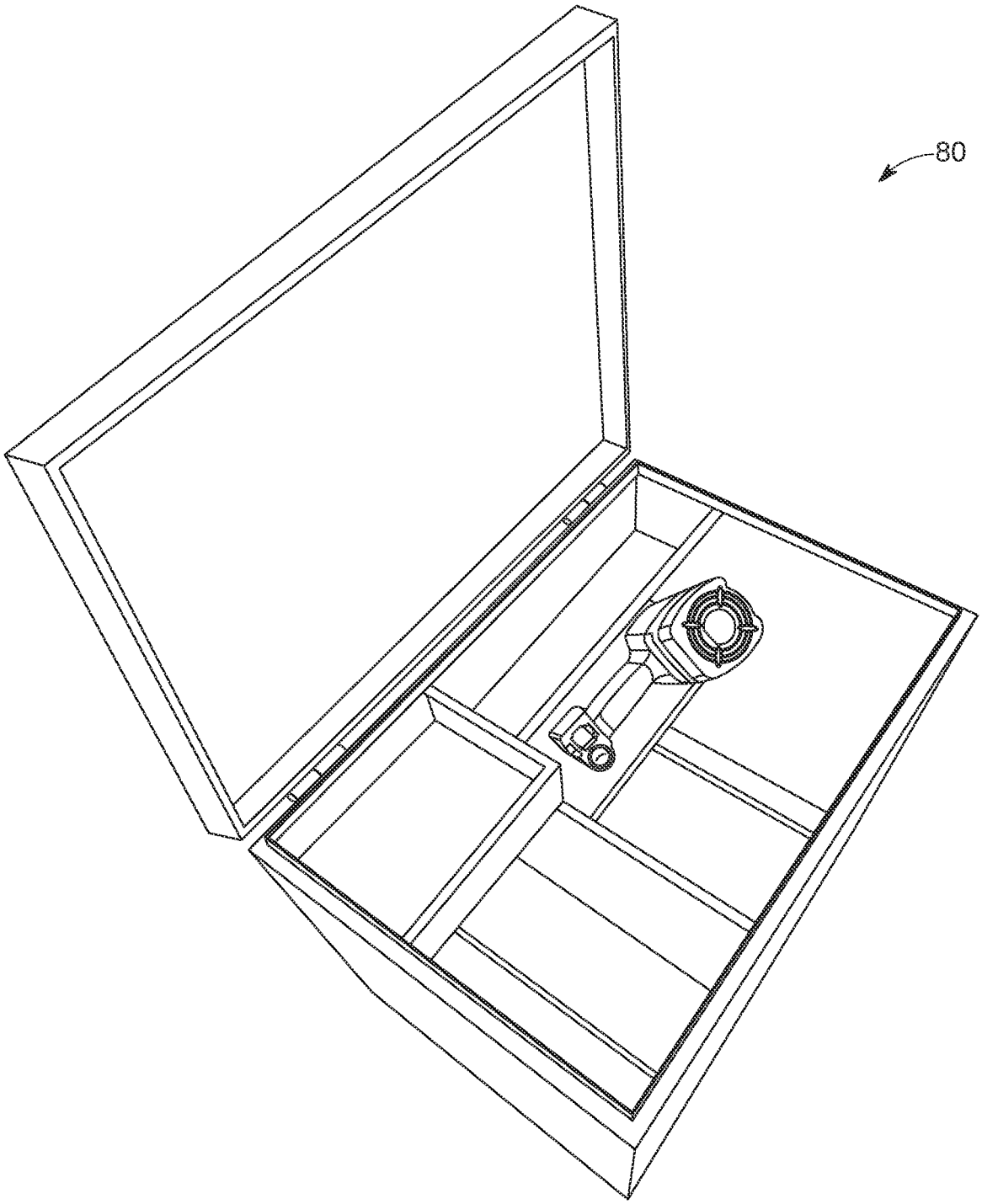
FIG. 12 shows a perspective view of an embodiment of a tool chest suitable for use with the disclosed technology.
Figure 13:
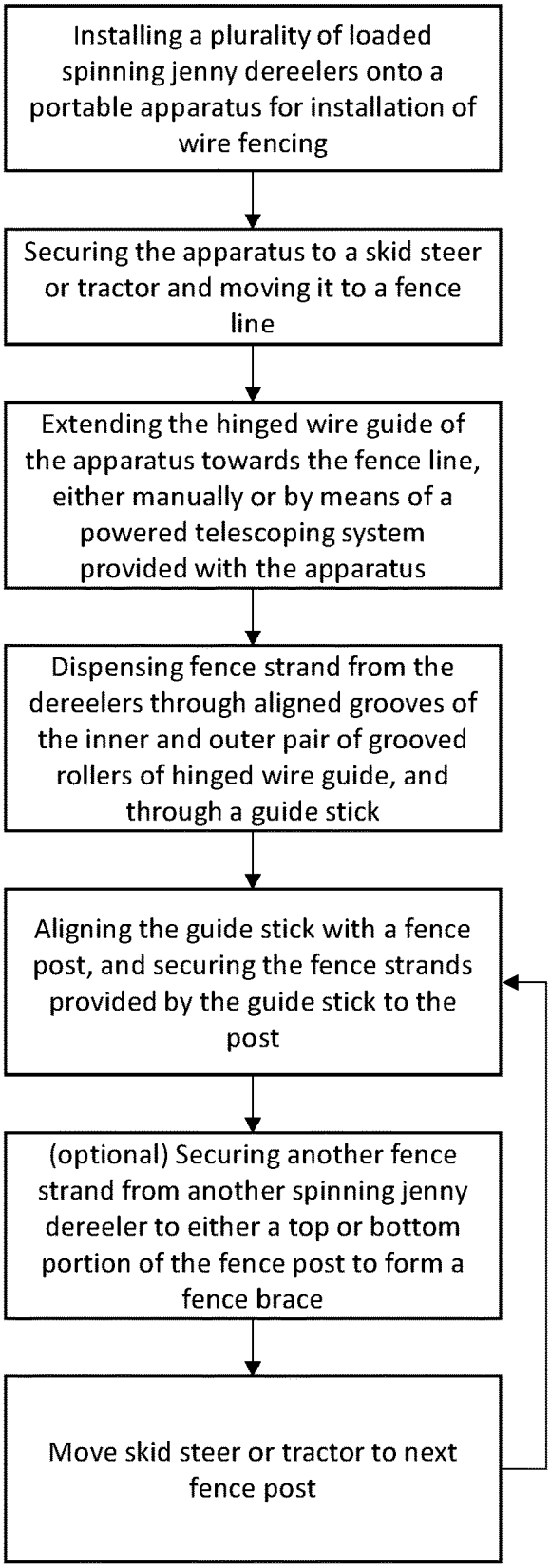
FIG. 13 shows a view of a method of the disclosed technology.

In the installation of fencing, various tools and equipment are needed, such as a steeple gun, cutters, crimp tool, tighteners, tightener tool, electric fence insulators, brace pins, and steeples. Therefore, the bottom structure of the frame further supports one or more tool chests 80, as shown in FIGS. 1, 2, 9 and 10. These chests may be secured to the bottom structure, or even integral therewith. As shown in FIG. 12, the interior of the chests may provide with affixed or movable trays or form compartments sized to receive various tools and equipment necessary or desirable in fence installation.

Finally, provided with the disclosed technology and particularly useful in the installation of fences when using the mountable apparatus as hereinabove described, are a plurality of guide sticks 60. Each of these guide sticks, as shown in FIG. 1, have a plurality of apertures to receive and organize fencing strands, such as 4, 5, 8 or 10 strands, wherein the position of the apertures align with the intended placement of the strands on the fence post.

The disclosed technology further includes a method of installing fencing along a fence line, an embodiment of which is presented in FIG. 12. In this method, an apparatus for installation of wire fencing is provided, the apparatus having a frame for supporting a plurality of spinning jenny dereelers loaded with fence strands, and a hinged wire guide. The hinged wire guide is presented with an inner pair of grooved rollers and an outer pair of grooved rollers. An apparatus described hereinabove is a suitable apparatus for practicing this method.

The method includes installing a plurality of spinning jenny dereelers loaded with fence strand on the portable apparatus secured to a skid steer, and moving it to the fence line. At the fence line, the hinged wire guide is extended in the direction of the fence line, either manually or if provided with a powered telescoping system. Fence strand is then dispensed from the spinning jenny dereelers through the aligned grooves of the inner pair of grooved rollers and the outer pair of grooved rollers.

Using a guide stick having apertures equal to the number of fence strands intended for installation on a plurality of fence posts 61, the fence strands are inserted through the apertures of the guide stick and the stick is aligned with a first post of a fence. Finally, the fence strands are secured to the fence post so that the strands are spaced on the first post in accordance with the spacing between the apertures of the guide stick. Notably, affixation of fence strands to fence posts should occur such that the guide stick continues to move with the apparatus down the fence line, with the fence strands running through the apertures (and doesn't get inadvertently secured between two posts). The skid steer then moves the apparatus, which draws fence strand out of the spinning jenny dereelers, and stops at the second post of the fence. The guide stick is then aligned with the second post, the strands are secured to the post according to the spacing of the guide stick (see FIG. 10), and the skid steer moves the apparatus and fence strand is affixed to a third and subsequent posts in like fashion, until the fence line is complete.

The method may also provide for bracing along the fence line, wherein another spinning jenny dereeler is installed to the top of and the distal end of the frame, and fence strand may be drawn from this spinning jenny dereeler and alternatingly affixed to an upper or lower end of the fence posts.

In this method, the portable apparatus may further include one or more tool chests supported on or secured to the bottom support structure, wherein tools for installing the fencing are provided in, and removable from, compartments within the tool chest. Likewise, the portable apparatus may have a pair of gate racks secured within and extendible from receptacles secured to the upper rack support structure, each gate rack including a long horizontal support tube and, at the distal end thereof, a cradle, and wherein the method further includes the step of loading one or more fencing gates on the gate racks, and removing the one or more fencing gates for installation on the fence line.

To load and replace the spinning jenny dereelers, the dereeler support bars may be provided along a segmented spinning jenny support post, each segment providing independent rotation with respect to the other segments. In this configuration, the support bars may be rotatably moved from their operational position to an open space for installation and replacement, by removing the bolt of a spring loaded bolt latch from an aperture of the support bar, thereby allowing rotation of the support bar out of the operational position. Once the spinning jenny dereeler loaded with fence strand is installed or replaced, the bar is returned to the operational position and the bolt of the latch is secured within the aperture of the support bar.

The invention claimed is:

1. A portable apparatus for use in the installation of wire fencing, the apparatus comprising:

a. a frame mountable to a skid steer or tractor loader, the frame including a bottom support structure, an upper rack support structure, a plurality of frame support posts securing the bottom support structure to the upper rack support structure, a pair of spinning jenny support posts affixed to the bottom support structure, and a mounting plate affixed to a proximal end of the frame;

b. a plurality of spinning jenny dereelers affixed to the spinner support posts by use of a plurality of spinner support bars; and c. a hinged wire guide affixed to a distal end of the frame, wherein the hinged wire guide comprises an upper bar and a lower bar each presented in segments, with one or more hinges for hingedly securing the segments of the upper bar and the lower bar, respectively, and further comprises an inner pair of grooved rollers at one end of the hinged wire guide, and an outer pair of grooved rollers at an opposing end of the hinged wire guide, thereby allowing the hinged wire guide to assume a compact position to facilitate storage and transport of the apparatus, while allowing the hinged wire guide to assume multiple extended positions when the apparatus is in use.

2. The portable apparatus of claim 1, further comprising one or more tool chests supported on or secured to the bottom support structure.

3. The portable apparatus of claim 1, further comprising a plurality of guide sticks useful in stringing a plurality of wires along a fence line, each guide stick presented with varying numbers of apertures positioned at pre-determined heights along the guide stick.

4. The portable apparatus of claim 1, further comprising a pair of gate racks secured within and extendible from receptacles secured to the upper rack support structure, each gate rack including a long horizontal support tube and, at the distal end thereof, a cradle.

5. The portable apparatus of claim 1, further comprising another spinning jenny dereeler rotatably affixed to the top of and the distal end of the frame.

6. The portable apparatus of claim 1, wherein each of the spinning jenny support posts is provided as multiple, independently rotatable segments, each segment supporting one of the spinner support bars.

7. The portable apparatus of claim 6, wherein rotation of each of the support post segments is selectively halted by use of a spring loaded bolt latch, the latch including a bracket, a bolt and a spring, wherein the latch bracket is affixed to the frame support post adjacent to the spinner support post such that the latch bolt is positioned to be received in and removable from an aperture of the spinner support bar when the spinner support bar is in an operational position.

8. The portable apparatus of claim 1 wherein the spinner support bars are rotatably affixed to the spinner support posts, and wherein rotation of each of the spinner support bars relative to the spinner support post is selectively halted by use of a spring loaded bolt latch.

9. The portable apparatus of claim 1, wherein the upper rack support structure comprises one or more vertical dividers and side lips.

10. The portable apparatus of claim 1, wherein the hinged wire guide is positioned relative to the frame by use of a powered telescoping system.

11. A method for installing fencing along a fence line, the method comprising the steps of:

a. installing a plurality of spinning jenny dereelers on a portable apparatus according to claim 3, the spinning jenny dereelers being loaded with fence strand;

b. securing the portable apparatus to a skid steer or tractor loader;

c. extending the hinged wire guide to assume one of a plurality of positions;

d. dispensing the fence strand from the spinning jenny dereelers through the aligned grooves of the inner pair of grooved rollers and the outer pair of grooved rollers;

e. inserting the fence strand through the apertures of the guide stick;

f. aligning the guide stick with a first post of a fence, and securing the fence strands to the fence so that the strands are spaced on the first post in accordance with the spacing between the apertures of the guide stick;

g. repeatedly moving the skid steer or tractor loader along the fence line, aligning the guide stick with a subsequent fence post, and securing the fence strands to the subsequent fence post.

12. The method for installing fencing of claim 11, wherein the portable apparatus further comprises one or more tool chests supported on or secured to the bottom support structure, and tools for installing the fencing are provided in, and removable from, compartments within the tool chest.

13. The method for installing fencing of claim 11, wherein the portable apparatus further comprises a pair of gate racks secured within and extendible from receptacles secured to the upper rack support structure, each gate rack including a long horizontal support tube and, at the distal end thereof, a cradle, and wherein the method further includes the step of loading one or more fencing gates on the gate racks, and removing the one or more fencing gates for installation on the fence line.

14. The method for installing fencing of claim 11, wherein the method further comprises installing another spinning jenny dereeler to the top of and the distal end of the frame, and further comprises drawing strand from the another spinning jenny dereeler and affixing the same to an upper or lower end of the first fence post and alternating ends of the subsequent fence posts.

15. The method for installing fencing of claim 11, wherein the spinning jenny support posts of the portable apparatus are provided as multiple, independently rotatable segments, each segment supporting one of the spinner support bars, and wherein rotation of each of the support post segments is selectively halted by use of a spring loaded bolt latch, the latch including a bracket, a bolt and a spring, wherein the latch bracket is affixed to the frame support post adjacent to the spinner support post such that the latch bolt is positioned to be received in and removable from an aperture of the spinner support bar when the spinner support bar is in an operational position, and wherein the method further comprises:

a. removing the latch bolt from the aperture of one of the spinner support bars, and rotating the spinning jenny support post to which such spinner support bar is attached out of the operational position prior to installing one of the spinning jenny dereelers thereon; and b. after installation of the spinning jenny dereeler rotating the spinning jenny support post back to the operational position and returning the latch bolt into the aperture of the spinner support bar.

16. The method for installing fencing of claim 11, wherein the hinged wire guide of the portable apparatus is extended by use of a powered telescoping system coupled with the controls of the skid steer or tractor loader.

* * * * *